US006492864B2

(12) United States Patent
Mahrla

(10) Patent No.: US 6,492,864 B2
(45) Date of Patent: Dec. 10, 2002

(54) CIRCUIT CONFIGURATION FOR LOW-POWER REFERENCE VOLTAGE GENERATION

(75) Inventor: Peter Mahrla, Zorneding (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/113,420

(22) Filed: Apr. 1, 2002

(65) Prior Publication Data

US 2002/0130710 A1 Sep. 19, 2002

Related U.S. Application Data

(63) Continuation of application No. PCT/DE00/03466, filed on Sep. 28, 2000.

(30) Foreign Application Priority Data

Sep. 30, 1999 (DE) ..... 199 47 115

(51) Int. Cl.[7] ..... G05F 1/10
(52) U.S. Cl. ..... 327/540
(58) Field of Search ..... 327/77, 81, 82, 327/87, 89, 308, 530, 534, 535, 537, 538, 540, 541, 543

(56) References Cited

U.S. PATENT DOCUMENTS 5,382,839 A * 1/1995 Shinohara ..... 327/530
6,281,734 B1 * 8/2001 McClure et al. ..... 327/308

FOREIGN PATENT DOCUMENTS

DE 31 05 198 A1 9/1982
FR 2 749 457 12/1997

OTHER PUBLICATIONS

"Halbleiterschaltungstechnik" (Semiconductor Technology) (U. Tietze et al.), 11th edition, Springer Verlag, 1999, pp. 974–1026.

* cited by examiner

*Primary Examiner*—Jeffrey Zweizig
(74) *Attorney, Agent, or Firm*—Laurence A. Greenberg; Werner H. Stemer; Ralph E. Locher

(57) ABSTRACT

A circuit configuration for low-power reference voltage generation, is described. The circuit has a programmable voltage source which generates an output voltage which is compared with a reference voltage at predetermined times. Depending on the comparison, at least one signal, which is supplied to a control device, is derived by a calibration device. The control device programs the voltage source in such a manner that the output voltage corresponds to the reference voltage as closely as possible.

13 Claims, 2 Drawing Sheets

CIRCUIT CONFIGURATION FOR LOW-POWER REFERENCE VOLTAGE GENERATION

CROSS-REFERENCE TO RELATED APPLICATION

This application is a continuation of copending International Application No. PCT/DE00/03466, filed Sep. 28, 2000, which designated the United States.

BACKGROUND OF THE INVENTION

FIELD OF THE INVENTION

The invention relates to a circuit configuration for low-power reference voltage generation.

A multiplicity of circuits for reference voltage generation are known, all of which, however, have a high intrinsic power consumption which reduces the operating period of, particularly, battery-operated applications and devices. In monolithic circuits, band gap references are frequently used which generate a constant reference voltage from a fluctuating voltage supply. However, band gap references themselves need a supply current of over 10 $\mu$A. Voltage regulators, too, usually have a band gap reference in order to generate a regulated supply voltage from a fluctuating voltage.

A circuit configuration for voltage generation is known from Published, Non-Prosecuted German Patent Application DE 31 05 198 A1. The circuit configuration described there contains a programmable voltage source which has an operational amplifier connected as an amplifier with a programmable voltage divider connected in its feedback path. The programmable voltage divider is used for setting the gain factor of the amplifier. At the output of the amplifier, an output voltage can be picked up. The circuit configuration also contains a calibration device which contains a potentiometer, a rectifier, a window discriminator and a comparator. At the input of the potentiometer, an alternating voltage is superimposed on an input voltage. The voltage present at the output of the potentiometer is rectified by the rectifier and supplied both to the window discriminator and to the comparator. The window discriminator and the comparator determine by comparisons with predetermined reference voltages whether the output tap of the potentiometer is located in the vicinity of one end of the potentiometer and towards which end it is moving. At the output end, the window discriminator and the comparator generate signals by which they feed a control device in the form of a counter. Depending on the signals fed in, the control device sets the gain factor of the programmable voltage source via a multiplexer.

A further circuit configuration for voltage generation is known from the Published, Non-Prosecuted French Patent Application FR 2 749 457 A3. This circuit configuration is used for converting a digital signal into an analog output voltage. The digital signal is input into decoders, one of which converts the more significant bits and the other one of which converts the less significant bits into analog signals. The analog signals are used for programming a voltage source. The programmable voltage source contains an operational amplifier, at the output of which the output voltage can be picked up. The non-inverting input of the operational amplifier is fed with a voltage that is generated by a voltage divider that contains a plurality of resistors and a plurality of controllable switches. The switches are controlled by the more significant bits of the digital signal. The inverting input of the operational amplifier is connected to the output of the operational amplifier via a feedback branch. A resistor is connected into the feedback branch. In addition, a current is fed into the feedback branch that is generated by a plurality of other controllable switches, transistors and other resistors. The further switches are controlled by the less significant bits of the digital signal. The magnitude of the output voltage is essentially determined by the current feeding the feedback branch and the voltage present at the non-inverting input of the operational amplifier. Furthermore, the output voltage feeds a circuit that supplies the output voltage as input quantity to a function. At the output end, the circuit generates a voltage that is applied to control terminals of the other resistors.

Overall, the circuit configuration described above shows that the more significant bits are used for coarse setting of the output voltage and the less significant bits are used for fine setting the output voltage.

SUMMARY OF THE INVENTION

It is accordingly an object of the invention to provide a circuit configuration for low-power reference voltage generation which overcomes the above-mentioned disadvantages of the prior art devices of this general type, which only needs a low supply current.

With the foregoing and other objects in view there is provided, in accordance with the invention, a circuit configuration for low-power reference voltage generation. The circuit configuration containing a programmable voltage source for generating an output voltage, a calibration device for deriving at least one signal in dependence on a comparison of the output voltage with a reference voltage at predetermined times, and a control device connected to and receiving the signal from the calibration device. The control device is connected to and programs the programmable voltage source so that the output voltage substantially corresponds to the reference voltage.

The invention relates to a circuit configuration for low-power reference voltage generation, in which a programmable voltage source generates an output voltage. The output voltage is compared with a reference voltage at predetermined times. Depending on the comparison, at least one signal, which is supplied to a control device, is derived by a calibration device. The control device programs the voltage source in such a manner that the output voltage corresponds to the reference voltage as closely as possible.

In this configuration, the actual regulated output voltage is generated by the programmable voltage source. A reference voltage source with a high current demand is only needed at the predetermined times when the output voltage is compared with the reference voltage. The programmable voltage source is used for simulating a reference voltage source, as it were, with the advantage that the programmable voltage source can be configured as a very low-power device. An advantage of the method thus relates to the fact that the reference voltage is only needed at certain times and, as a result, it is not necessary to operate a reference voltage source continuously. For example, a band gap reference providing the reference voltage is only switched on at predetermined times and switched off again in-between times. The method considerably lowers the current demand particularly if the programmable voltage source is recalibrated again only at relatively large time intervals.

The programmable voltage source is preferably configured as a programmable voltage divider that is fed by a voltage source. The current consumption of the programmable voltage source can be distinctly lowered particularly by high resistance values of the voltage divider. A further advantage lies in the simple structure of the voltage divider and of the voltage source feeding the voltage divider. If high resistance values are used for the voltage divider, it is not only the current consumption that is lowered but the feeding voltage source is also loaded to a lesser extent.

The voltage divider preferably has a multiplicity of series-connected resistors and individual resistors of the voltage divider can be bridged in each case by a switch. This embodiment can be advantageously constructed in a very simple circuit. As an alternative, the voltage divider can also be constructed as a parallel connection of resistors. In an integrated circuit in the currently available semiconductor and integration technologies, however, this embodiment requires a larger area.

The values of the resistors are preferably graduated in such a manner that the values of in each case series-connected resistors differ by a factor of two and each resistance value is a multiple of a predetermined resistance value. This makes it possible to achieve a finely graduated characteristic of the voltages programmable by the voltage divider. In addition, the ratios between resistors can be achieved more accurately than absolute values, especially in integrated circuit technology.

The control device programs the voltage divider preferably by closing or opening individual switches. The switches are preferably constructed as MOSFET transistors of the enrichment type. This embodiment facilitates an integration of the method with other circuits, particularly in a monolithic CMOS circuit. MOSFET transistors have been found to be successful as switches in digital technology due to their good switching characteristics and their low load path resistance and are thus also suitable for the almost resistanceless bridging of individual resistors of the voltage divider. It is especially MOSFET transistors of the enrichment type which are suitable as switches since these transistors only begin to conduct from a certain control voltage and thus reliably cut off with a control voltage of 0 V and slightly above.

The control device preferably digitally stores the programming of the voltage divider. Digital storage of the programmed setting of the voltage divider can be achieved, on the one hand, by very simply achieved, particularly in integrated circuit technology and, on the other hand, is more reliable than, for example, analog storage which is afflicted with losses and with which adequate long-term stability, for example over a number of weeks, can scarcely be achieved, particularly due to leakage currents.

The control device is constructed particularly preferably as a digital counter with an upcounting and downcounting function. Digital counters are available in a multiplicity of embodiments, can be implemented by simple construction and, in particular, can be constructed as a very low-power device, particularly in CMOS technology.

The digital counter is preferably clocked by a counting clock, the counting pulses of which correspond to the predetermined times for comparing the output voltage.

The times for comparing the output voltage with the reference voltage are preferably predetermined in dependence on fluctuations or changes in the output voltage. In the case of fluctuations with little spacing in time, a calibration must be performed correspondingly more frequently than in the case of fluctuations with a large spacing in time.

The voltage divider is especially preferably followed by a regulating element that is controlled by the voltage divider in such a manner that when the output voltage of the voltage divider drops below a predetermined voltage, the regulating element decreases the current flow. The regulating element is preferably constructed as an n-channel MOSFET transistor of the enrichment type connected as a common-source circuit or, for example, in BICMOS technology as an npn bipolar transistor connected as an emitter-follower circuit. This prevents, on the one hand, the voltage divider from being loaded by too high an output current and, on the other hand, buffer capacitors from becoming discharged via resistors in the circuit, particularly when the supply voltage drops.

Finally, a positive temperature coefficient of the regulating element is preferably compensated for by diodes connected into the voltage divider.

Other features which are considered as characteristic for the invention are set forth in the appended claims.

Although the invention is illustrated and described herein as embodied in a circuit configuration for low-power reference voltage generation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
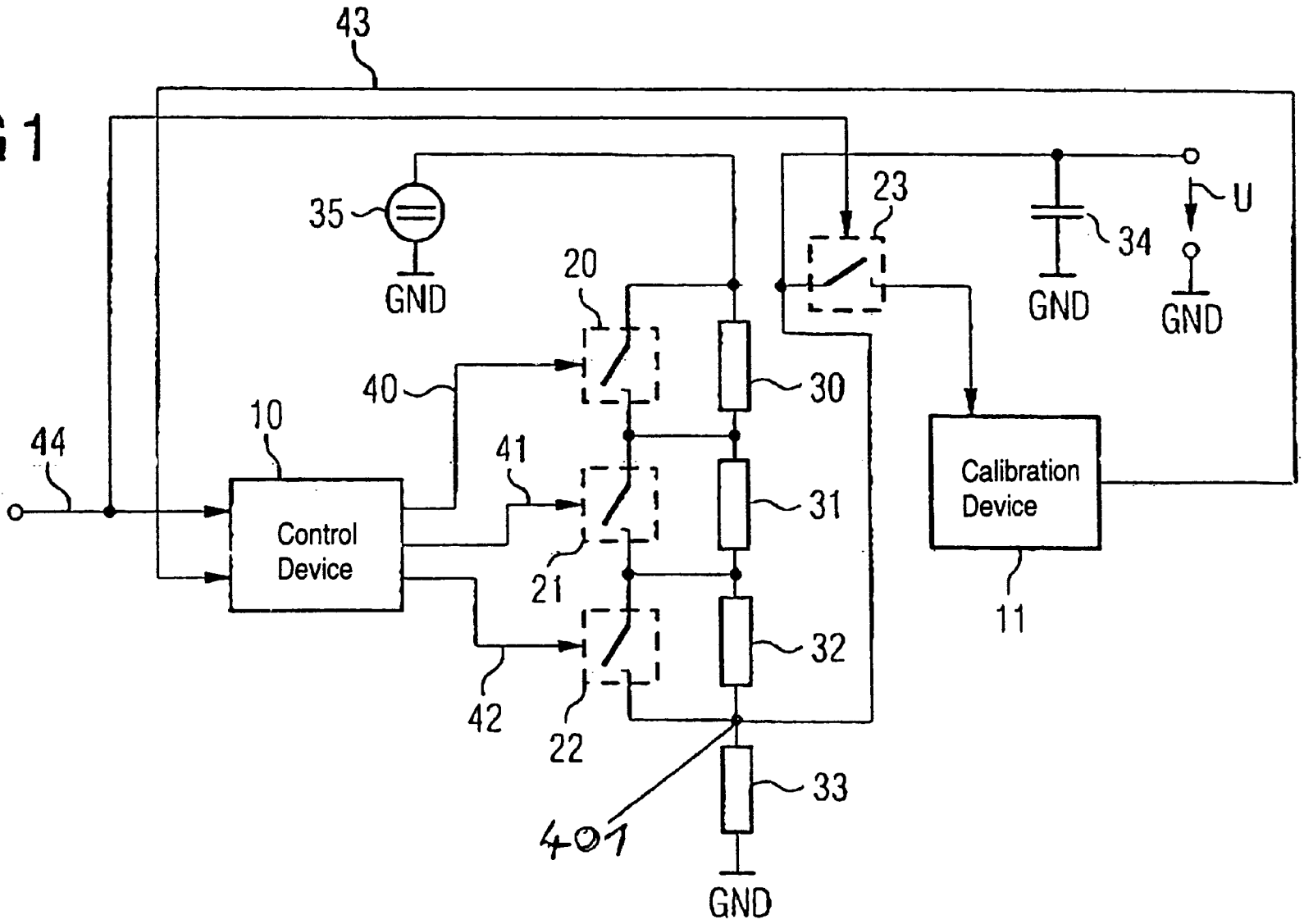
FIG. 1 is a block circuit diagram of a first exemplary embodiment of a circuit configuration according to the invention.

Referring now to the figures of the drawing in detail and first, particularly, to FIG. 1 thereof, there is shown a voltage source 35 that feeds a programmable voltage divider which has four series-connected resistors 30 to 33. A bottom end of the voltage divider and one terminal of the voltage source 35 are connected to a reference potential GND of 0 V. The values of the four resistors 30 to 33 of the voltage divider are graduated as follows: resistor 30 is 2×R0, resistor 31 is 4×R0 and resistor 32 is 8×R0. This results in a finely graduated characteristic of the programmable voltage divider. Resistors 30 to 32 can be bridged in each case by a parallel-connected switch 20, 21 and 22, respectively. The voltage divider can be programmed via the switches 20 to 22.

The switches 20 to 22 are opened or closed by a control device by in each case one control signal 40, 41 and 42, respectively. This makes it possible to adjust an output voltage U at point 401 of the voltage divider. To avoid abrupt changes in the output voltage U in the event of a change of the current at the output, the output voltage U is buffered with respect to the reference potential GND via a capacitor 34.

The point 401 is connected via a further switch 23 to a calibration device 11 which measures the voltage at the feed point of the voltage divider with the switch 23 closed and compares it with a reference voltage. A calibration pulse 44 closes the switch 23 and also activates the control device 10 for programming the voltage divider. Depending on the comparison, the calibration device 11 regulates the control device 10 via a regulating signal 43 and the control device 10 in turn programs the voltage divider in such a manner that the voltage at point 401 corresponds to the reference voltage as closely as possible. However, it is also possible to execute another regulating rule, for example to program the voltage divider in such a manner that the voltage at point 401 corresponds to half the reference voltage. This depends on the regulating rule incorporated in the calibration device 11.

Figure 2:
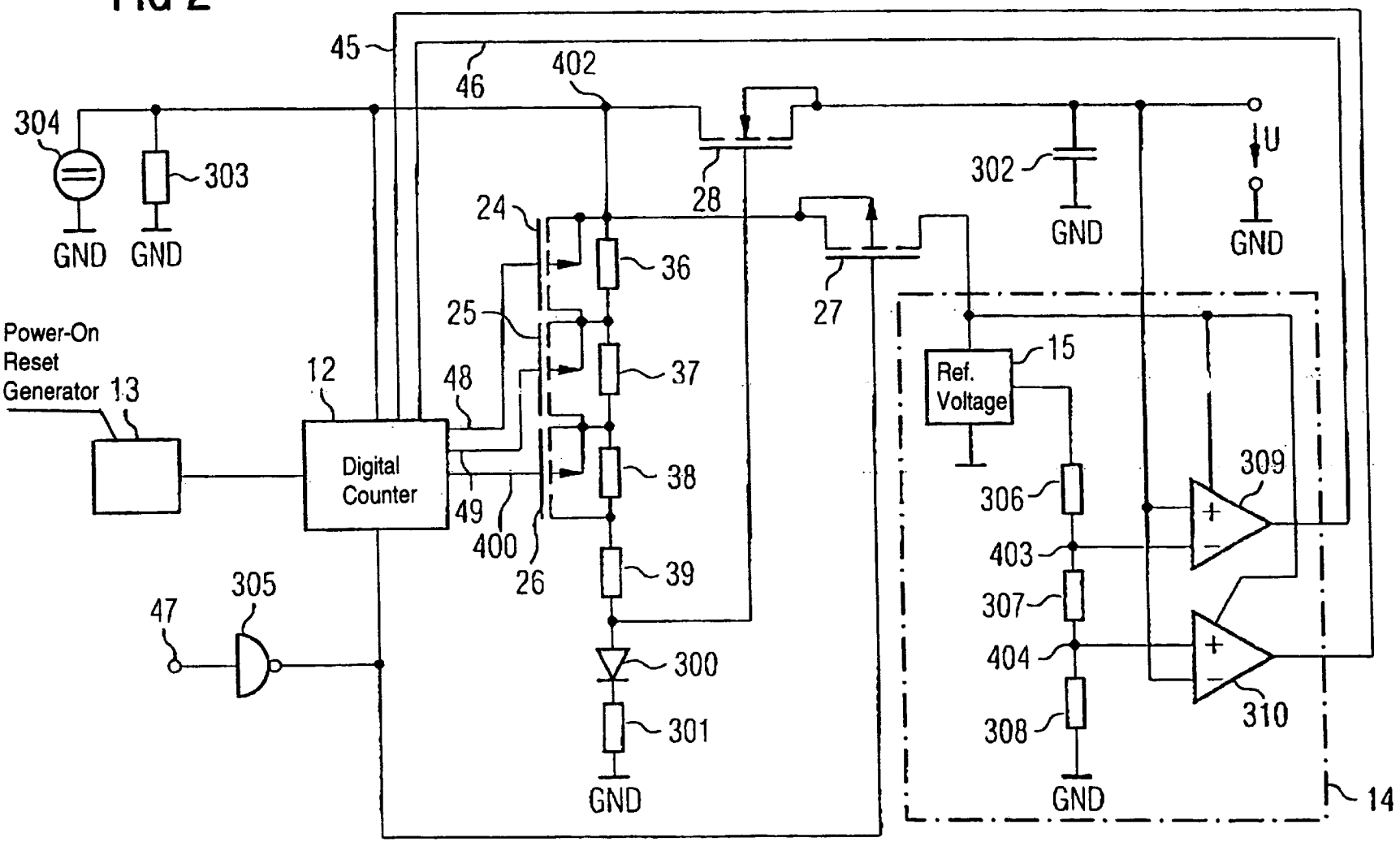
FIG. 2 is a block circuit diagram of a second exemplary embodiment of the circuit configuration according to the invention, in CMOS technology.

In FIG. 2, a voltage source 304 feeds a programmable voltage divider at a feed point 402. The voltage divider contains four series-connected resistors 36 to 39, a forward-biased diode 300 which is connected in series with the four resistors 36 to 39, and a fifth resistor 301 connected in series therewith. A bottom end of the voltage divider is connected to the reference potential GND of 0 V. A load path of a p-channel MOSFET transistor 24, 25 and 26, respectively, of the enrichment type is in each case connected in parallel with three resistors 36 to 38. The transistors 24 to 26 are in each case controlled by a bit2 signal 48 or a bit1 signal 49 or a bit0 signal 400, respectively.

The bit2 signal 48, the bit1 signal 49 and the bit0 signal 400 are in each case a digital output signal of a digital counter 12 which programs the voltage divider. The digital counter 12 is an up/downcounter. A direction of counting is set by an upcounting signal 45 and a downcounting signal 46. The digital counter 12, like the voltage divider, is fed by the voltage source 304.

At the time of calibration, a calibration device 14 is supplied with current via a MOSFET transistor 27. The calibration device 14 has a voltage reference 15 that is supplied by the voltage at the feed point 402 of the voltage divider via the transistor 27. The output voltage of the voltage reference 15 feeds a voltage divider having three series-connected resistors 306 to 308, the bottom end of which is connected to the reference potential GND. A voltage at two center points of the voltage divider 403 and 404 is in each case supplied to the inverted input of a comparator 309 and the non-inverted input of a comparator 310, respectively. The comparators compare the supplied voltages with the output voltage U of the overall circuit. The downcounting signal 46 is then present at the output of the comparator 309 and the upcounting signal 45 is present at the output of the comparator 310.

The transistor 27 and the digital counter 12 are activated by a calibration pulse 47. For this purpose, the calibration pulse 47 is supplied by an inverter 305 that steepens the edges of the calibration pulse.

Furthermore, an n-channel MOSFET transistor 28 of the enrichment type is provided which is controlled by a voltage at the p-terminal of the diode 300 and reduces the internal resistance of the N-channel MOSFET when the output voltage U drops, and thus counteracts the drop in the output voltage. The diode 300 partially compensates for a positive temperature coefficient of the n-channel MOSFET transistor 28.

In the text that follows, the operation of the circuit will be briefly explained: a calibration pulse causes the transistor 27 to close. As a result, the calibration device 14 is supplied. Depending on the supply voltage of the calibration device 14, either the comparator 309 or 310, and thus the up- or downcounting signal 45 or 46, respectively, switches. The digital counter 12 correspondingly counts up or down by one bit, for example from "000" to "001", and thus switches one of the transistors 24 to 26 on or off, respectively. As a result, the voltage at the feed point of the voltage divider correspondingly changes.

In the event of a voltage failure and restarting of the supply voltage, a power-on reset generator 13 resets the digital counter 12 to an initial state.

I claim:

1. A circuit configuration for low-power reference voltage generation, comprising:

a programmable voltage source for generating an output voltage;

a calibration device for deriving at least one signal in dependence on a comparison of the output voltage with a reference voltage at predetermined times; and a control device connected to and receiving the signal from said calibration device, said control device connected to and programming said programmable voltage source so that the output voltage substantially corresponds to the reference voltage.

2. The circuit configuration according to claim 1, wherein said programmable voltage source has a voltage source and a programmable voltage divider connected to and fed by said voltage source.

3. The circuit configuration according to claim 2, wherein said programmable voltage divider has switches and a multiplicity of series-connected resistors, and at least some of said resistors of said programmable voltage divider can be bridged in each case by a respective one of said switches.

4. The circuit configuration according to claim 3, wherein said resistors have values that are graduated in such a manner that the values of neighboring series-connected resistors differ by a factor of two and each respective resistance value is a multiple of a predetermined resistance value.

5. The circuit configuration according to claim 3, wherein said control device programs said programmable voltage divider by closing or opening individual one of said switches.

6. The circuit configuration according to claim 3, wherein said switches are MOSFET transistors of an enrichment type.

7. The circuit configuration according to claim 2, wherein said control device digitally stores a programming of said programmable voltage divider.

8. The circuit configuration according to claim 7, wherein said control device is a digital counter with an upcounting and downcounting function.

9. The circuit configuration according to claim 8, wherein said digital counter is clocked by a counting clock having counting pulses, the counting pulses corresponding to the predetermined times for comparing the output voltage.

10. The circuit configuration according to claim 1, wherein the predetermined times for comparing the output voltage with the reference voltage are predetermined in dependence on one of fluctuations and changes in the output voltage.

11. The circuit configuration according to claim 2, further comprising a regulating element following and connected to said programmable voltage divider, said regulating element controlled by said programmable voltage divider in such a manner that when the output voltage drops, said regulating element counteracts a drop in the output voltage by reducing an internal resistance.

12. The circuit configuration according to claim 11, wherein said regulating element is a switch selected from the group consisting of an n-channel MOSFET transistor of an enrichment type connected as a common-source circuit and an npn bipolar transistor connected as an emitter-follower circuit.

13. The circuit configuration according to claim 11, further comprising a diode connected to said programmable voltage divider for compensating for a positive temperature coefficient of said regulating element.

* * * * *